US011603622B2

(12) United States Patent
Jung et al.

(10) Patent No.: US 11,603,622 B2
(45) Date of Patent: Mar. 14, 2023

(54) LAUNDRY TREATMENT APPARATUS

(71) Applicant: LG Electronics Inc., Seoul (KR)

(72) Inventors: Sungwoon Jung, Seoul (KR); Hunjun Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/238,927

(22) Filed: Apr. 23, 2021

(65) Prior Publication Data

US 2021/0332522 A1 Oct. 28, 2021

(30) Foreign Application Priority Data

Apr. 24, 2020 (KR) ..... 10-2020-0050259

(51) Int. Cl.

| | |
|---|---|
| ***D06F 39/02*** | (2006.01) |
| ***D06F 34/20*** | (2020.01) |
| ***D06F 23/02*** | (2006.01) |
| ***D06F 39/12*** | (2006.01) |
| *D06F 103/40* | (2020.01) |

(52) U.S. Cl.
CPC ..... *D06F 39/028* (2013.01); *D06F 23/02* (2013.01); *D06F 34/20* (2020.02); *D06F 39/12* (2013.01); *D06F 2103/40* (2020.02)

(58) Field of Classification Search
None
See application file for complete search history.

(56) References Cited

U.S. PATENT DOCUMENTS

| | | | | |
|---|---|---|---|---|
| 2009/0235697 | A1* | 9/2009 | Reid | D06F 39/12 68/3 SS |
| 2016/0186370 | A1* | 6/2016 | Kim | D06F 37/04 68/17 R |
| 2017/0159221 | A1* | 6/2017 | Cho | D06F 33/43 |

FOREIGN PATENT DOCUMENTS

| | | | | |
|---|---|---|---|---|
| DE | 102009027876 | | 1/2011 | |
| EP | 1959045 | | 4/2010 | |
| EP | 2476792 | | 7/2012 | |
| EP | 2476792 | B1 * | 1/2018 | B67D 3/0003 |
| KR | 10-2018-0090003 | | 8/2018 | |
| WO | WO2015022622 | | 2/2015 | |

OTHER PUBLICATIONS

Extended European Search Report in European Appln. No. 21169561.4, dated Sep. 17, 2021, 9 pages.

* cited by examiner

*Primary Examiner* — Cristi J Tate-Sims
(74) *Attorney, Agent, or Firm* — Fish & Richardson P.C.

(57) ABSTRACT

A laundry treatment apparatus is disclosed. The laundry treatment apparatus includes a housing, a tub, a drum, and a storage unit, and a supply case arranged in the housing to accommodate the storage unit introduced through the opening. The supply case includes an introduction detector coupled to an outer side of the supply case and configured to detect whether the storage unit is introduced, and an overhang positioned over the introduction detector to block water from falling on the introduction detector.

20 Claims, 11 Drawing Sheets

LAUNDRY TREATMENT APPARATUS

CROSS-REFERENCE TO RELATED APPLICATION

This application claims the benefit of Korean Patent Application No. 10-2020-0050259, filed on Apr. 24, 2020, which is hereby incorporated by reference as if fully set forth herein.

TECHNICAL FIELD

The present disclosure relates to a laundry treatment apparatus, and more particularly, to a laundry treatment apparatus including a detergent supply device.

BACKGROUND

A laundry treatment apparatus is an apparatus that removes contaminants from clothes, bedding, etc. (hereinafter referred to as laundry) put into a drum. The laundry treatment apparatus may perform operations such as washing, rinsing, dehydration, and drying. The laundry treatment apparatuses may be divided into a top loading type apparatus and a front loading type apparatus depending on how the laundry is put into the drum.

The laundry treatment apparatuses may include a housing defining an exterior, a tub accommodated in the housing, a drum rotatably mounted inside the tub and configured to receive laundry introduced thereinto, and a detergent supply device configured to supply detergent into the drum.

When the drum is rotated by a motor while washing water is supplied to the laundry contained in the drum, dirt on the laundry may be removed due to friction against the drum and the washing water.

The detergent supplying device has a function of supplying detergent to enhance the washing effect. Here, the detergent refers to a material that enhances the laundry effect, such as a fabric detergent, a fabric softener, and a fabric bleach. As a detergent, a powder detergent or a liquid detergent may be used.

Korean Patent Application Publication No. 10-2018-0090003 A1 discloses a detergent supply device included in a laundry treatment apparatus. In using the laundry treatment apparatus, the storage unit of the detergent supply device may be inserted or removed by a user.

A detergent may be stored in the storage unit, and the detergent supply device may provide the detergent stored in the storage unit to the tub. In addition, the detergent supply device may have various electrical components including a circuit and the like using electricity, such as a pump to check the state of withdrawal/placement of the storage unit, checking the supply state of water, or supply detergent.

However, the laundry treatment apparatus uses water and detergent to wash laundry, and the detergent supply device uses a mixture of detergent and water. As a large amount of water is used inside the laundry treatment apparatus, condensation of water is very likely to occur. The condensed water may infiltrate into the electrical components, resulting in corrosion or failure.

Accordingly, it is an important task in the present technical field to prevent water from infiltrating into electrical components arranged inside the laundry treatment apparatus and to secure water resistance for the electrical components.

SUMMARY

Embodiments of the present disclosure are intended to provide a laundry treatment apparatus capable of effectively preventing water from infiltrating into electrical components.

Embodiments of the present disclosure are also intended to provide a laundry treatment apparatus capable of effectively improving the water resistance of electrical components by efficiently treating water present in the laundry treatment apparatus.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

In accordance with one aspect of the present disclosure, a laundry treatment apparatus may include an overhang. The overhang may effectively prevent water from falling on an introduction detector configured to detect an introduction state of a storage unit in a detergent supply device.

The overhang are positioned over the introduction detector to block water from falling from above the introduction detector toward the introduction detector. Accordingly, water falling toward the introduction detector may be collected by the overhang.

The overhang may be provided with a discharge region through which water falling from above is drained. The discharge region is an area in which an overhang upper rib formed at the edge of the overhang is not present, and the overhang may discharge water through the region without the overhang upper rib.

The laundry treatment apparatus according to an embodiment of the present disclosure as described above may include a housing, a tub, a drum, a storage unit, and a supply case. The housing may be provided with an opening in a front thereof, the tub may be arranged in the housing. The drum may be rotatably arranged in the tub, and the storage unit may be introduced into and withdrawn from the housing through the opening and store a detergent therein. The supply case may be arranged in the housing to accommodate the storage unit introduced through the opening.

The supply case may include an introduction detector coupled to an outer side of the supply case and configured to detect whether the storage unit is introduced, and an overhang positioned over the introduction detector to block water from falling on the introduction detector.

The overhang may include an overhang panel formed in a plate shape and positioned over the introduction detector, and an overhang upper rib protruding upward from the overhang panel and extending along at least a part of an edge of the overhang panel to block water on the overhang panel from leaking.

The overhang panel may be shielded by providing the overhang upper rib at a part of the edge, and a remaining part of the edge may be opened to form a discharge region for draining water.

The introduction detector and the overhang may protrude rearward from a rear wall of the supply case, wherein the overhang panel may have one side end protruding from the rear wall in a side direction of the supply case. The discharge region may be positioned at the one side end of the supply case.

The introduction detector may be arranged on one side of the rear wall with respect to the side direction, wherein the overhang panel may have another side end protruding rearward from the one side of the rear wall and positioned over the introduction detector. The side one end of the overhang panel may be positioned over the tub.

The overhang panel may be inclined to guide water on the overhang panel to the discharge region.

A front end of the overhang panel may be positioned lower than a rear end of the overhang panel, wherein the discharge region may include at least a part of the front end of the overhang panel.

The one side end of the overhang panel may be positioned lower than another side end of the overhang panel.

The overhang panel may be vertically spaced apart from the introduction detector to define a space between the overhang panel and the introduction detector.

The overhang may further include an overhang lower rib protruding downward from an edge of the one side end of the overhang panel.

The supply case may be provided with a slide coupling groove on the rear wall thereof, the slide coupling groove being coupled to the introduction detector when the introduction detector is slid, wherein the introduction detector may include a slide coupling portion inserted into and coupled to the slide coupling groove by sliding in the side direction.

The introduction detector may include a detection case coupled to a rear wall of the supply case and protruding rearward from the rear wall, and a detection projection protruding forward from the detection case and having a front end positioned inside the supply case through the rear wall.

The introduction detector may be configured to detect whether the storage unit is introduced based on whether the detection projection is pressed by the storage unit.

The detection projection may be moved in a front-back direction of the supply case when pressed by the storage unit, wherein the introduction detector further may include a first terminal arranged in the detection case, at least a part of the first terminal being displaced according to movement of the detection projection, and a second terminal positioned on a movement path of the first terminal in the detection case.

The introduction detector may detect whether the storage unit is introduced, based on the first terminal and the second terminal contact each other.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
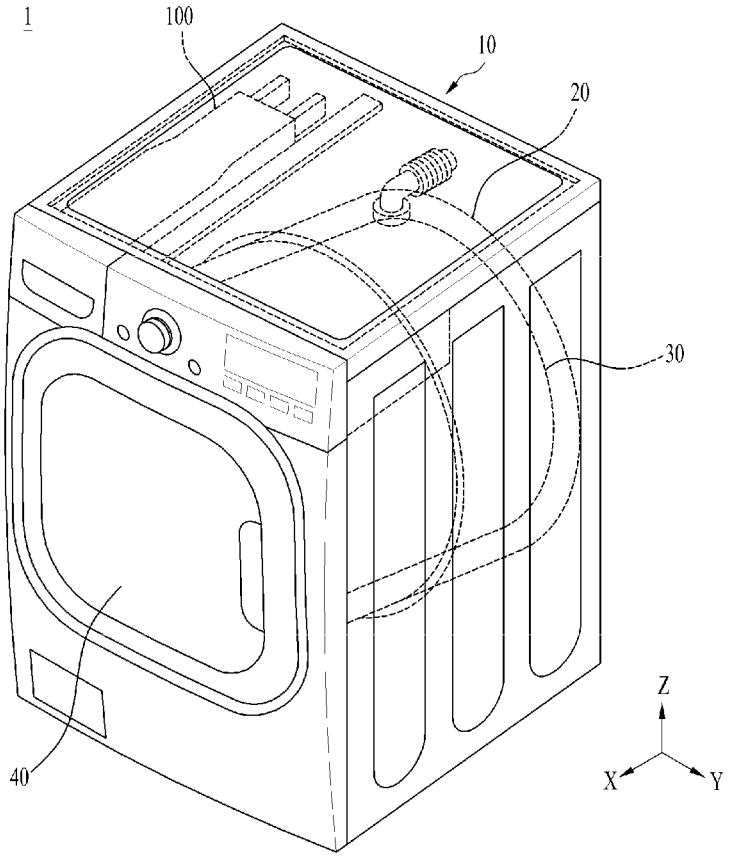
FIG. 1 is a view showing a laundry treatment apparatus according to an embodiment of the present disclosure.

Hereinafter, embodiments of the present disclosure will be described in detail with reference to the accompanying drawings to provide a further understanding of the present disclosure to those of ordinary skill in the art.

It will be apparent to those skilled in the art that the present disclosure can be implemented in various different forms and is not limited to the embodiments described herein. In the drawings, parts irrelevant to the description are omitted in order to clearly describe the present disclosure. Wherever possible, the same reference numbers will be used throughout the specification to refer to the same or like parts.

In this specification, redundant descriptions of the same components are omitted.

When one constituent is mentioned as being "connected" or "linked" to another constituent, this should be understood as meaning that one constituent may be directly connected or linked to the other constituent or another constituent may be interposed between the constituents. On the other hand, when one constituent is mentioned as being "directly connected" or "directly linked" to another constituent, this should be understood as meaning that no other constituent is interposed between the constituents.

Terms used in this specification are merely adopted to describe specific embodiments, and are not intended to limit the present disclosure.

A singular expression may include a plural expression unless the context clearly indicates otherwise.

In this specification, a term "include" or "have" is intended to indicate that characteristics, figures, operations, operations, constituents, and components disclosed in the specification or combinations thereof exist. The term "include" or "have" should be understood as not precluding existence or addition of one or more other characteristics, figures, operations, operations, constituents, components, or combinations thereof.

In this specification, the term "and/or" includes a combination of a plurality of listed items or any of the plurality of listed items. In this specification, "A or B" may include "A," "B," or "both A and B."

Figure 2:
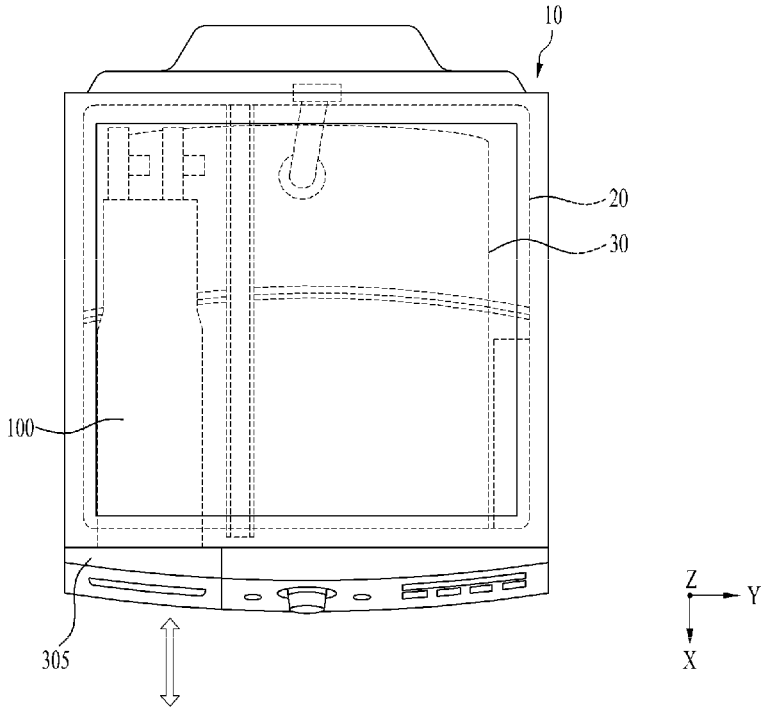
FIG. 2 is a view showing the laundry treatment apparatus of FIG. 1 viewed from above.

FIG. 1 is a perspective view showing a laundry treatment apparatus 1 according to an embodiment of the present disclosure, and FIG. 2 is a top view of the laundry treatment apparatus 1 of FIG. 1 viewed from above.

Referring to FIGS. 1 and 2, the laundry treatment apparatus 1 may include a housing 10 having an opening 15 in a front thereof, and a tub 20 arranged in the housing 10, a drum 30 rotatably arranged in the tub 20, and a detergent supply device 100 arranged in the opening 15.

The laundry treatment apparatus 1 may include a washing machine in which washing, rinsing and dehydration are performed on fabric items inserted into the washing tub, or a dryer in which drying is performed on wet fabric items inserted thereinto.

The laundry treatment apparatus 1 may be divided into a top-load type and a front-load type. FIG. 1 shows a front-load type laundry treatment apparatus 1, which is merely intended for convenience of explanation. The present disclosure may be applied to a top-load type washing machine as well as a front-load type washing machine.

As shown in FIG. 1, the laundry treatment apparatus 1 may include a housing 10 defining an exterior thereof. The housing 10 may be provided with a manipulation unit configured to receive various control instructions from a user. The manipulation unit may have a display configured to display information on an operation state.

In addition, the housing 10 may have a door 40 arranged on a front side thereof. The door 40 may be rotatably arranged on the housing 10 to regulate withdrawal/placement of laundry from/into the drum 30.

The housing 10 may define the exterior of the laundry treatment apparatus 1. A space to accommodate various components constituting the laundry treatment apparatus 1 may be defined in the housing 10. A drum 30 to accommodate laundry introduced through the door 40 may be arranged inside the housing 10.

Specifically, the tub 20 containing washing water may be arranged inside the housing 10, and the drum 30 may be rotatably arranged inside the tub 20 to accommodate laundry. A balancer for compensating for eccentricity caused by rotation may be arranged on one side of the drum 30.

The manipulation unit may include various keys configured to manipulate the operation state of the laundry treatment apparatus 1 and a display configured to display the operation state of the laundry treatment apparatus 1. The door 40 may include a transparent member such as tempered glass allowing the inside of the housing 10 or the drum 30 to be visually checked.

As shown in FIG. 1, in an embodiment of the present disclosure, the laundry treatment apparatus 1 may have an opening 15 in the front thereof, and the detergent supply device 100 may be arranged at the rear of the opening 15 in the housing 10.

The location and shape of the opening 15 may vary. FIG. 1 shows that an opening 15 opened forward is in the front of the housing 10. The opening 15 may be positioned in a corner region of the front of the housing 10, for example, at one side of the upper end of the front of the housing 10 so as to be parallel to the manipulation unit in the side direction.

Figure 3:
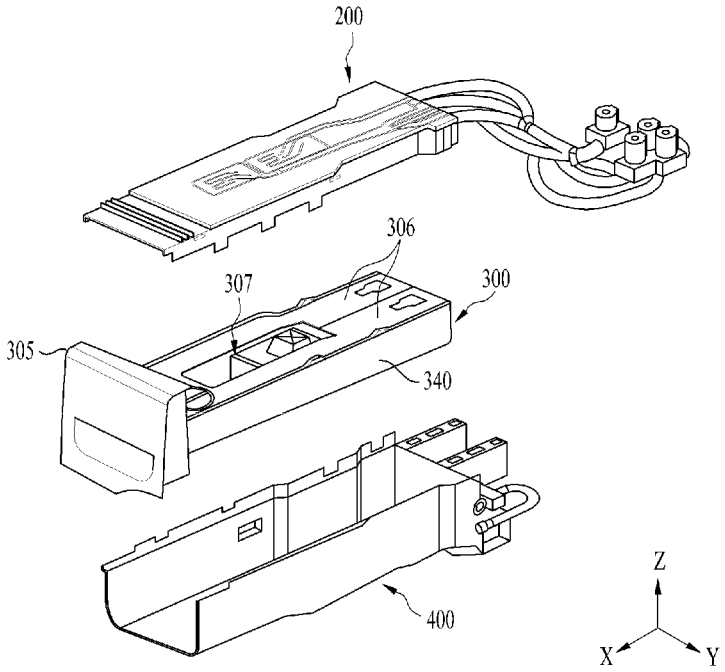
FIG. 3 is an exploded view showing a detergent supply device in the laundry treatment apparatus according to an embodiment of the present disclosure.

FIG. 3 is an exploded view showing the detergent supply device 100 according to an embodiment of the present disclosure. Referring to FIGS. 2 and 3, the detergent supply device 100 according to the embodiment may be positioned at the rear of the opening 15, which may be provided on one side of the upper portion of the housing 10, in the housing 10.

The detergent supply device 100 may include a storage unit 300 capable of storing detergent, a dispenser unit 200 disposed at the top of the storage unit 300 to supply water to the storage unit 300, and a supply case 400 configured to accommodate the storage unit 300 put into the housing 10.

The detergent supply device 100 may serve to automatically supply the detergent stored in the storage unit 300 into the drum 30 during the washing operation. The detergent refers to a material capable of enhancing the laundry washing effect, and may include a powder or liquid fabric detergent and a liquid fabric softener.

FIG. 3 shows an exploded view of the detergent supply device 100. As shown in FIG. 3, the detergent supply device 100 may include the dispenser unit 200, the storage unit 300, and the supply case 400 from top to bottom.

The dispenser unit 200 may be supplied with water from the outside, and may in turn supply the supplied water to the storage unit 300 or the supply case 400. Detergent to be used in the washing operation may be stored in the storage unit 300, and the storage unit 300 may be accommodated and seated in the supply case 400. The supply case 400 may receive water discharged from the dispenser unit 200 or at least a part of the detergent stored in the storage unit 300, and supply the same to the tub 20 or the like.

The storage unit 300, in which the detergent is stored, may be introduced into the housing 10 or withdrawn from the housing 10 through the opening 15 in the front-rear direction. The storage unit 300 may include a handle 305 disposed at the front, a storage frame 340, and a detergent storage container 306 and a detergent cup seated on the storage frame 340.

In the present disclosure, the front and the rear may be defined based on the position of the opening 15 in the housing 10. For example, a side facing in a direction from the inside of the housing 10 toward the opening 15 may be defined as the front, and the opposite side may be defined as the rear.

In other words, a side facing the direction from the inside of the housing 10 toward the outside of the housing 10 through the opening 15 may be defined as the front, and a side facing in the direction from the opening 15 toward the inside of the housing 10 may be defined as the rear.

That is, in the present disclosure, even when the door 40 and the opening 15 are provided on different surfaces of the housing 10, the front and rear sides may be defined based on the opening 15.

The dispenser unit 200 and the supply case 400 may be arranged at the rear of the opening 15 in the housing 10, and the storage unit 300 may be introduced into or withdrawn from the housing 10 through the opening 15.

When the user grips and pulls out the handle 305 provided at the front of the storage unit 300 and exposed to the outside of the housing 10 with the storage unit 300 put in the housing 10 through the opening 15, the storage unit 300 placed through the opening 15 may be moved forward from the stack of the dispenser unit 200 and the supply case 400 and drawn out to be exposed to the outside of the housing 10.

When the user pushes the handle 305 to the rear side, the storage unit 300 may be inserted into the opening 15 in a sliding manner.

In an embodiment of the present disclosure, the storage unit 300 may be withdrawn by a set withdrawal distance determined by design of a stopper or the like. However, this limitation of the withdrawal distance is optional, and the user may withdraw the storage unit 300 as far as the set withdrawal distance or completely withdraw the same as needed.

In an embodiment of the present disclosure, the storage unit 300 may include a storage frame 340, a detergent storage container 306, and a detergent accommodation region 307. A detergent accommodation portion and a detergent cup may be provided in the detergent accommodation region 307.

The storage frame 340 may be put in or withdrawn from the housing 10 through the opening 15 with the detergent storage container 306 or the detergent cup mounted thereon. The storage frame 340 may have a length extending in the front-rear direction, and may have an open top, which allows the user to easily mount the detergent storage container 306 and the detergent cup.

The storage frame 340 may put in or withdrawn from the housing 10 through the opening 15 in various ways. For example, the supply case 400 may be provided with a sliding rail along the storage frame 340 is slid, and the storage frame 340 may be supported on the sliding rail and be slid in and out by a user.

In addition, the handle 305 may be arranged at the front of the storage frame 340. The cross section of the handle 305 viewed from the front may be larger than the storage frame 340. Thus, the handle 305 may shield the opening 15 so as not to be exposed to the outside.

The detergent storage container 306 may have a storage space to store detergent. The detergent storage container 306 is detachably mounted on the storage frame 340, and the user may separate and wash or replace the detergent storage container 306 as needed.

The detergent storage container 306 may be mounted on the storage frame 340 through the open top of the storage frame 340, and the number of the detergent storage containers 306 may vary as needed.

The detergent accommodation region 307, in which detergent is accommodated, may be provided in the storage frame 340. A detergent accommodation portion may be provided in the detergent accommodation region 307. The detergent accommodation portion may be formed as a part of the storage frame 340. For example, the detergent accommodation portion may have a space defined by a detergent accommodation wall protruding from the bottom surface of the storage frame 340 to accommodate detergent.

The detergent is accommodated in the detergent accommodation portion separately from the detergent storage container 306. For simplicity, the detergent stored in the detergent storage container 306 may be referred to as a first detergent, the detergent stored in the detergent accommodation portion in the detergent accommodation region 307 may be referred to as a second detergent, and the detergent accommodated in the detergent cup in the detergent accommodation region 307 may be referred to as a third detergent.

The first detergent, the second detergent, and the third detergent are only distinguished by an object to be stored, and may not necessarily have different characteristics. In an embodiment of the present disclosure, a plurality of regions which detergents may be stored may be provided to allow the user to use various detergents.

As the detergent accommodation portion has an open top, detergent may be introduced thereinto. The user may introduce detergent through the open top of the detergent accommodation portion with the storage unit 300 withdrawn from the housing 10, for example, withdrawn by a set withdrawal distance as shown in FIG. 3.

The detergent cup may be detachably mounted in the detergent accommodation region 307 in the storage frame 340. As the detergent cup is mounted, the detergent accommodation region 307 may be divided into the detergent cup and the detergent accommodation portion.

As the detergent cup has an open top, detergent may be introduced thereinto. The detergent introduced into the detergent cup may be defined as a third detergent for distinction. The user may introduce the same or different detergents into the detergent storage container 306, the detergent accommodation portion, and the detergent cup, respectively, as needed.

For example, a liquid detergent may be introduced into the detergent storage container 306, a powder detergent may be introduced into the detergent accommodation portion, and a fabric softener, which is a type of detergent, may be introduced into the detergent cup.

However, as described above, the first, second, and third detergents do not necessarily have different characteristics. Thus, the user may use the first, second, and third detergents of the same type, and store the detergent in only one of the detergent storage container 306, the detergent accommodation portion, and the detergent cup.

The detergent cup may be positioned adjacent to the detergent accommodation portion. As the detergent accommodation portion and the detergent cup, which have an open top, are positioned adjacent to each other, the user may conveniently and distinctively use the detergent accommodation portion and the detergent cup without unnecessarily using the spaced detergent accommodation region 307.

Figure 4:
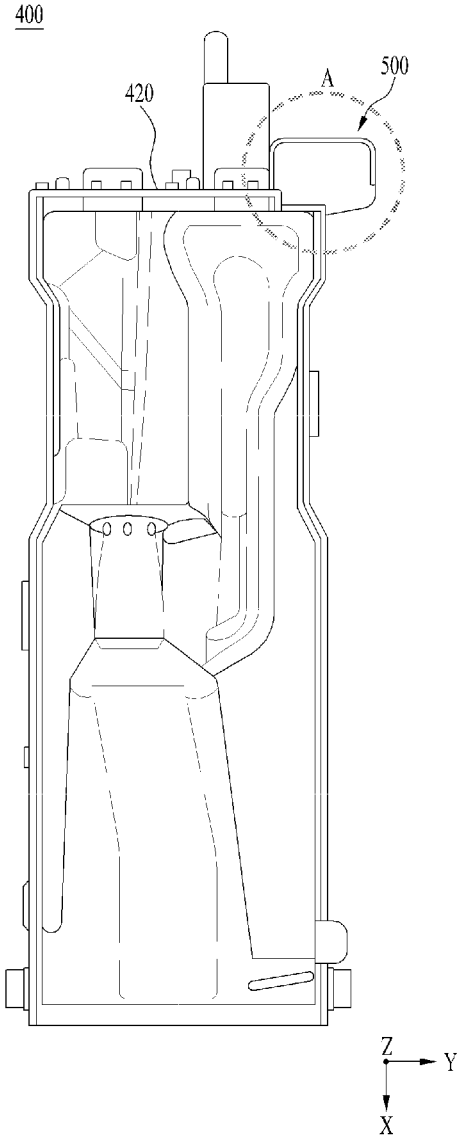
FIG. 4 is a view showing a supply case in the laundry treatment apparatus according to an embodiment of the present disclosure.

FIG. 4 shows a supply case 400 constituting the detergent supply device 100 in the laundry treatment apparatus 1 according to an embodiment of the present disclosure. The supply case 400 of FIG. 4 is provided with an overhang 500 on the rear side.

As described above, the laundry treatment apparatus 1 according to the embodiment of the present disclosure includes the housing 10, the tub 20, the drum 30, the storage unit 300, and the supply case 400. The housing 10 may be provided with an opening 15 in the front thereof, and the tub 20 may be arranged inside the housing 10. The drum 30 may be rotatably arranged inside the tub 20.

The storage unit 300 may be introduced into or withdrawn from the housing 10 through the opening 15, and a detergent may be stored therein. The supply case 400 may be arranged inside the housing 10, and may accommodate the storage unit 300 introduced through the opening 15.

The supply case 400 includes an introduction detector 600 and an overhang 500. The introduction detector 600 is coupled to the outside of the supply case 400 and is configured to detect whether the storage unit 300 is introduced. The overhang 500 is disposed over the introduction detector 600 to block the water from falling to the introduction detector 600.

Figure 5:
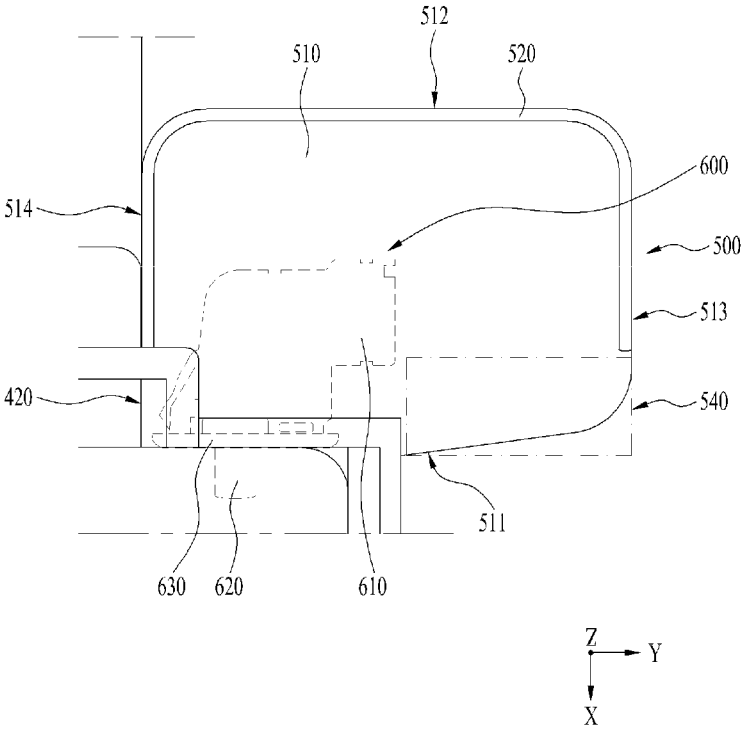
FIG. 5 is an enlarged view of area A of FIG. 4.

FIG. 5 is an enlarged view showing area A of FIG. 4. Referring to FIGS. 4 and 5, the supply case 400 is provided with the introduction detector 600, and an overhang 500 is arranged over the introduction detector 600. The top surface of the introduction detector 600 may be shielded by the overhang 500.

The introduction detector 600 may be coupled to the outside of the supply case 400 and may be configured to detect whether the storage unit 300 is introduced. There may be various ways in which the introduction detector 600 detects whether the storage unit 300 is introduced.

For example, a part of the introduction detector 600 is positioned inside the supply case 400 and check whether it contacts the storage unit 300 in an electrical or physical manner. The introduction detector 600 may be an optical sensor configured to detect light reflected from the storage unit 300 or may be an infrared sensor.

In one embodiment of the present disclosure, detecting, the operation of the introduction detector 600 of detecting whether the storage unit 300 is introduced includes not only determining, by the introduction detector 600, whether the storage unit 300 is introduced, but also generating different signals depending on whether the storage unit 300 is introduced.

For example, the introduction detector 600 may be configured such that a controller or the like directly determines whether the storage unit 300 is introduced according to a condition that varies depending on whether the storage unit 300 is introduced, or that whether to generate an electric signal is simply changed depending on whether the storage unit 300 is introduced.

That is, in one embodiment of the present disclosure, the operation of the introduction detector 600 of detecting whether the storage unit 300 is introduced includes directly determining whether the storage unit 300 is introduced and generating an electrical signal that varies depending on whether the storage unit 300 is introduced.

The introduction detector 600 detects whether the storage unit 300 is introduced. In one embodiment of the present disclosure, once the storage unit 300 is introduced, this means that the storage unit 300 is disposed at the correct introduction position.

The storage unit 300 may be introduced into or withdrawn from the housing 10 through the opening 15 of the housing 10 by a user. When the storage unit 300 is introduced, the storage unit 300 may not be fully placed inside as intended for use.

As described above, when the storage unit 300 is insufficiently moved during the introduction process and thus fails to reach the correct introduction position, that is, when the storage unit 300 is not fully introduced, the detergent may not be smoothly supplied during operation of the laundry treatment apparatus 1.

In an embodiment of the present disclosure, in order to pre-recognize such a situation, the introduction detector 600 may be configured to detect whether the storage unit 300 is fully introduced.

Since the storage unit 300 is accommodated in the supply case 400, it may be disadvantageous in design to secure a space for position of the introduction detector 600 inside the supply case 400.

Accordingly, in one embodiment of the present disclosure, the introduction detector 600 may be coupled to the outside of the supply case 400 so as to detect whether the storage unit 300 in the supply case 400 is fully introduced.

The introduction detector 600 configured as described above may use an electrical signal or may include a metal material. For example, the introduction detector 600 may include an element to generate an electric or radio signal indicating that introduction of the storage unit 300 is completed, and may include an element made of a metal material.

The detergent supply device 100 may use water through the dispenser unit 200 or the like, and a plurality of water supply hoses may be provided in the dispenser unit 200. In addition, as shown in FIG. 2, the tub 20 or the like accommodating a large amount of water may be disposed below the detergent supply device 100.

That is, a large amount of water may be present in the laundry treatment apparatus 1, and condensation of water may easily occur due to high humidity. In some cases, unintended leakage of water may occur.

As described above, water that is unintentionally present in the laundry treatment apparatus 1 may fall toward the introduction detector 600. For example, water may leak or condensate from the water supply hose provided in the dispenser unit 200 and fall on the introduction detector 600. In addition, as water condensing on the inner surface of the upper wall of the housing 10 falls, it may infiltrate into the introduction detector 600.

When water formed due to various causes falls on the introduction detector 600, the introduction detector 600 may be corroded or damaged due to the infiltration of water. The corrosion or damage may disturb the detection of introduction of the storage unit 300 during the operation of the laundry treatment apparatus 1.

Accordingly, an embodiment of the present disclosure is directed to effectively preventing water from falling to the introduction detector 600 by providing the overhang 500 over the introduction detector 600.

The overhang 500 may be disposed over the introduction detector 600. The introduction detector 600 and the overhang 500 may be coupled to the outside of the supply case 400 or may be integrated with the supply case 400.

The overhang 500 may be arranged to shield the introduction detector 600 when viewed from above. The overhang 500 may be arranged to cover the entirety of the introduction detector 600 or to cover a part of the introduction detector 600 when viewed from above.

The overhang 500 is positioned over the introduction detector 600 to physically block water from falling from above the introduction detector 600 to the introduction detector 600. That is, water falling from above the introduction detector 600 toward the introduction detector 600 may collide with the overhang 500 and may remain on the overhang 500.

As described above, according to an embodiment of the present disclosure, as the introduction detector 600 corresponding to an electrical component is positioned outside the supply case 400 and the overhang 500 is arranged over the introduction detector 600, water may be effectively prevented from falling on the introduction detector 600.

FIG. 5 shows the overhang 500 viewed from above. In the figure, the introduction detector 600 arranged on the rear side of the supply case 400 according to an embodiment of the present disclosure is indicated by a dotted line.

Figure 6:
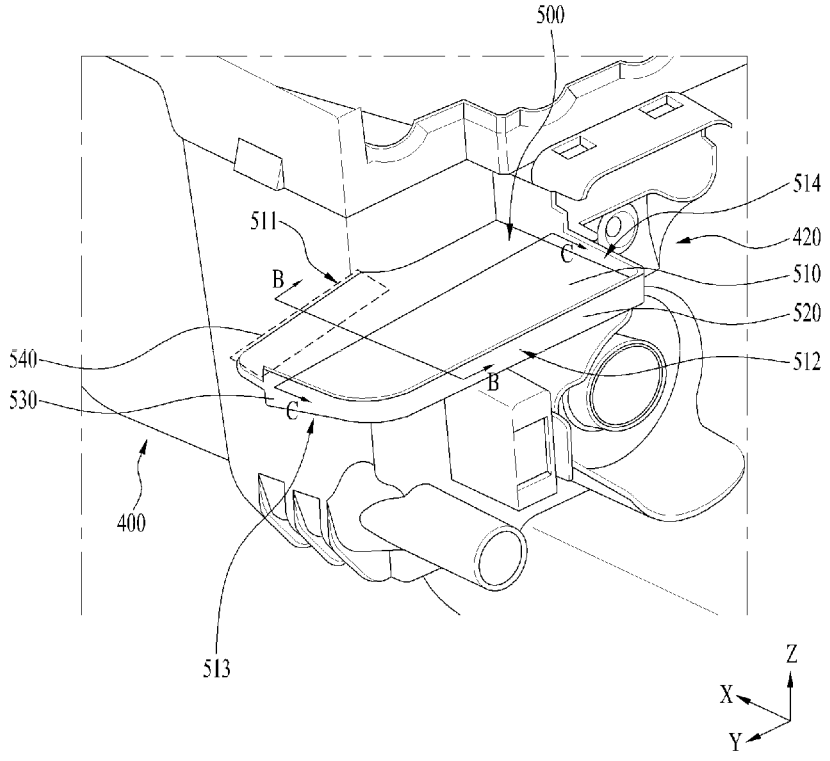
FIG. 6 is a view showing an overhang in the laundry treatment apparatus according to an embodiment of the present disclosure.

FIG. 6 is a rear view of the overhang 500 according to the embodiment of the present disclosure. Referring to FIG. 6, in the embodiment of the present disclosure, the overhang 500 may include an overhang panel 510 and an overhang upper rib 520.

The overhang panel 510 may be formed in a plate shape and be positioned over the introduction detector 600. The overhang upper rib 520 protrudes upward from the overhang panel 510 and extends along at least a part of the edge of the overhang panel 510 to prevent water on the overhang panel 510 from leaking.

The overhang panel 510 may be formed in a substantially plate shape. When viewed from above, the overhang panel 510 may have various shapes such as a circle or a polygon. The overhang panel 510 shown in FIGS. 5 and 6 has a substantially rectangular shape according to an embodiment of the present disclosure.

As the overhang panel 510 is positioned over the introduction detector 600, water falling from above the introduction detector 600 may collide with and collect on the overhang panel 510 prior to the introduction detector 600. The overhang panel 510 may take the form of a panel extending in a direction transverse to the vertical direction.

The overhang panel 510 may have an area larger than the area of the introduction detector 600 and may be arranged to shield the introduction detector 600 as a whole when viewed from above.

The overhang upper rib 520 may protrude upward from the overhang panel 510. The overhang upper rib 520 may extend along the edge of the overhang panel 510. That is, the overhang upper rib 520 may have a shape extending so as to surround the top surface of the overhang panel 510.

The overhang upper rib 520 may extend along at least a part of the edge of the overhang panel 510. For example, the overhang upper rib 520 may extend along the entire edge of the overhang panel 510 to form a closed section, or may extend along a portion of the edge of the overhang panel 510. That is, the overhang upper rib 520 may be removed from a portion of the overhang panel 510 to form a discharge region 540, which will be described later.

Water falling on the top surface of the overhang panel 510 may be prevented from flowing to the outside of the overhang panel 510 by the overhang upper rib 520. Without the upper overhang rib 520, water on the overhang panel 510 may flow to the outside beyond the edge of the overhang panel 510. In this case, part of the water may infiltrate into the introduction detector 600 positioned below the overhang panel 510.

Accordingly, in an embodiment of the present disclosure, the overhang upper rib 520 may extend along the edge of the overhang panel 510 to safely prevent water falling on the overhang panel 510 from leaking to the outside of the overhang 500. FIG. 6 shows the overhang upper rib 520 provided at the edge of the overhang panel 510 according to an embodiment of the present disclosure.

Referring to FIGS. 5 and 6, in the embodiment of the present disclosure, the overhang panel 510 may be shielded by the overhang upper rib 520 provided at a portion of the edge, and the rest of the edge may be open to form a discharge region 540 for draining water.

In an embodiment of the present disclosure, in a region of the edge of the overhang panel 510 where the overhang upper rib 520 is provided, the overhang upper rib 520 may prevent water from leaking to the outside. That is, a portion of the edge of the overhang panel 510 may be shielded by the overhang upper rib 520 to block the flow of water when viewed from a side.

In an embodiment of the present disclosure, the overhang panel 510 may have a discharge region 540 formed thereon. The discharge region 540 may include an edge of the overhang panel 510 at which the overhang upper rib 520 is not present. That is, in the discharge region 540, the overhang upper rib 520 may be removed from the edge of the overhang panel 510.

FIGS. 5 and 6 show the discharge region 540 defined on the overhang 500. Since the overhang upper rib 520 is not present in the discharge region 540, water present on the overhang panel 510 may leak out of the overhang 500 through the discharge region 540.

In an embodiment of the present disclosure, as the overhang upper rib 520 is arranged at the edge of the overhang panel 510, water on the overhang panel 510 may be prevented from leaking to the outside indiscriminately. In addition, as the discharge region 540 where the overhang upper rib 520 is not present is designed, the water on the overhang panel 510 may be discharged to the side that is intended in design.

An element that is robust or irrelevant to infiltration of water may be positioned below the discharge region 540. For example, an element that is hardly affected by contact with water in terms of function or durability, such as various types of hoses or the tub 20, may be positioned below the discharge region 540.

In an embodiment of the present disclosure, the introduction detector 600 and the overhang 500 may be arranged to protrude rearward from the rear wall 420 of the supply case 400, and the overhang panel 510 may be arranged such that one side end 513 thereof protrudes beyond the rear wall 420 in the side direction of the supply case 400. The discharge region 540 may be positioned at the one side end 513.

Referring to FIG. 4, in an embodiment of the present disclosure, the introduction detector 600 and the overhang 500 may be provided on the rear wall 420 of the supply case 400. The introduction detector 600 and the overhang 500 may be arranged to protrude rearward from the rear wall 420 of the supply case 400. The introduction detector 600 and the overhang 500 may be coupled to the rear wall 420 of the supply case 400 or may be integrated therewith.

FIGS. 5 and 6 show that the overhang 500 protruding rearward from the rear wall 420 of the supply case 400 are integrated with the rear wall 420 according to an embodiment of the present disclosure.

The overhang panel 510 may be arranged to protrude beyond the rear wall 420 of the supply case 400 in a side direction. That is, the overhang panel 510 has one side end 513 arranged on the rear side of the supply case 400 to protrude from the supply case 400 in the side direction, and the other side end 514 may be positioned at the rear wall 420 of the supply case 400.

The overhang 500 may have a discharge region 540 formed at one side end 513 protruding from the supply case 400 in the side direction. Accordingly, water drained from the overhang 500 through the discharge region 540 may fall to a position spaced apart from the supply case 400 in the side direction.

Accordingly, water discharged from the overhang 500 may be effectively prevented from unintentionally invading some of the components constituting the detergent supply device 100 and causing damage or corrosion thereto.

In an embodiment of the present disclosure, the introduction detector 600 may be arranged on one side of the rear wall 420 in the side direction, and the overhang panel 510 may be positioned over the introduction detector 600 with the other side end 514 protruding rearward from the one side of the rear wall 420.

The introduction detector 600 may be disposed biased to one side of the rear wall 420 of the supply case 400, and the other side end 514 of the overhang panel 510 may be arranged on the one side of the rear wall 420 so as to protrude rearward.

The introduction detector 600 and the other side end 514 of the overhang panel 510 may be arranged on one side of the rear wall 420 of the supply case 400 facing the center of the housing 10. The other side end 514 of the overhang panel 510 may be positioned over the introduction detector 600, and the one side end 513 may extend from the other side end 514 in the side direction so as to protrude from the rear wall 420 of the supply case 400 in the side direction.

In an embodiment of the present disclosure, as the introduction detector 600 and the overhang panel 510 are positioned biased to one side on the rear wall 420 of the supply case 400, water may be blocked from falling on the introduction detector 600, and collected water may be discharged to the outside of the detergent supply device 100.

As shown in FIG. 2, the one side end 513 of the overhang panel 510 may be positioned over the tub 20. The tub 20 is an object to accommodate water and is thus water proof. Accordingly, the water discharged through the discharge region 540 provided at the one side end 513 of the overhang panel 510 may fall into the tub 20 and be effectively treated.

Figure 7:
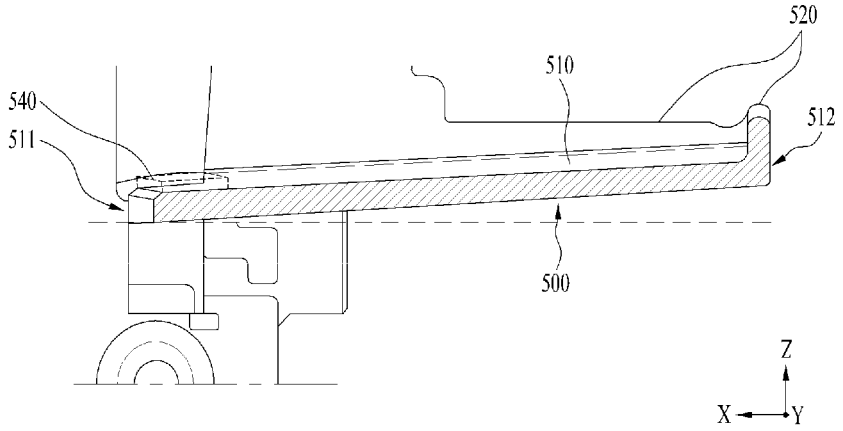
FIG. 7 is a cross-sectional view of the overhang, taken along line B-B in FIG. 6.
Figure 8:
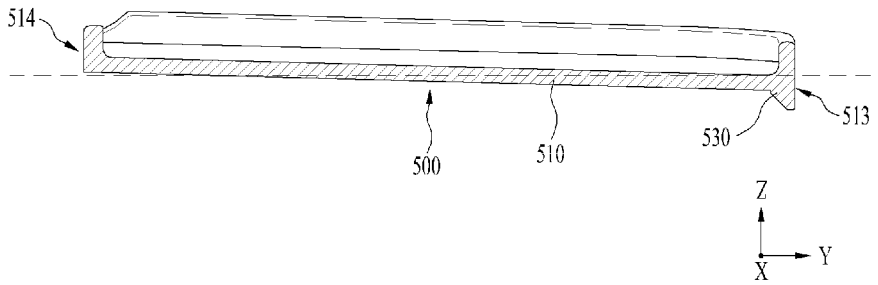
FIG. 8 is a cross-sectional view of the overhang, taken along line C-C in FIG. 6.

FIG. 7 is a cross-sectional view of the overhang 500, taken along line B-B in FIG. 6, and FIG. 8 is a cross-sectional view of the overhang 500 of FIG. 6, taken along line C-C in FIG. 6. Referring to FIGS. 7 and 8, in an embodiment of the present disclosure, the overhang panel 510 may be arranged to be inclined such that water on the overhang panel 510 is guided to the discharge region 540.

Accordingly, drainage of water present on the overhang panel 510 may be effectively induced, and harmful substances such as mold may be effectively suppressed on the overhang panel 510.

Referring to FIGS. 6 and 7, in an embodiment of the present disclosure, the overhang panel 510 may be inclined such that the front end 511 is positioned lower than the rear end 512, and the discharge region 540 may include at least a part of the front end 511 of the overhang panel 510.

The overhang panel 510 may form an inclined surface such that the front end 511 is positioned lower than the rear end 512. On at least the top surface of the overhang panel 510, the front end 511 may be positioned lower than the rear end 512. On both the top surface and the bottom surface, the front end 511 may be positioned lower than the rear end 512.

The overhang panel 510 may have an inclined surface having an inclination such that the height thereof increases as the panel extends from the front to the rear. The top surface of the overhang panel 510 may have a curved surface, or may be formed of a plurality of inclined surfaces having different inclinations.

As the overhang panel 510 is inclined such that the height thereof decreases as the panel extends forward, water collected on the overhang panel 510 may flow toward the front end 511 of the overhang panel 510. In addition, as the discharge region 540 of the overhang 500 includes the front end 511 of the overhang panel 510, water concentrated at the front end 511 of the overhang panel 510 may be discharged to the outside through the discharge region 540.

That is, as the discharge region 540 is formed at the front end 511 of the overhang panel 510 by removing the overhang upper rib 520 from at least a part of the edge, water concentrated at the front end 511 may be effectively discharged through the discharge region 540.

Referring to FIGS. 6 and 8, in an embodiment of the present disclosure, the overhang panel 510 may be arranged to be inclined such that the one side end 513 is positioned lower than the other side end 514.

That is, the overhang panel 510 may form an inclined surface having a height as the panel extends from the other side end 514 to the one side end 513. The inclined surface may be formed on the top surface of the overhang panel 510, or on both the top surface and the bottom surface of the overhang panel 510.

Water collected on the overhang panel 510 may flow toward one side end 513 of the overhang panel 510. That is, the water collected on the overhang panel 510 may concentrated at the side of the one side end 513 of the overhang panel 510, and may be discharged to the outside of the overhang 500 through the discharge region 540 including the one side end 513.

As shown in FIG. 6, in one embodiment of the present disclosure, the discharge region 540 may include the one side end 513 of the overhang panel 510 and may also include the front end 511 of the overhang panel 510. A plurality of discharge regions 540 may be arranged. One of the discharge regions 540 may be provided at the one side end 513 of the overhang panel 510, and the other of the discharge regions 540 may be arranged at the front end 511 of the overhang panel 510. Alternatively, as shown in FIG. 6, one discharge region 540 may be arranged to include one corner of the front end of the overhang panel 510.

The end where the discharge region 540 is formed may be understood as being formed by removing the overhang upper rib 520 from at least a part of the edge. FIG. 6 shows that the overhang upper rib 520 has been successively removed from an edge positioned at one side of the front end of the overhang panel 510 and an edge positioned at the front side of one side end of the overhang panel 510 in accordance with an embodiment of the present disclosure.

Figure 9:
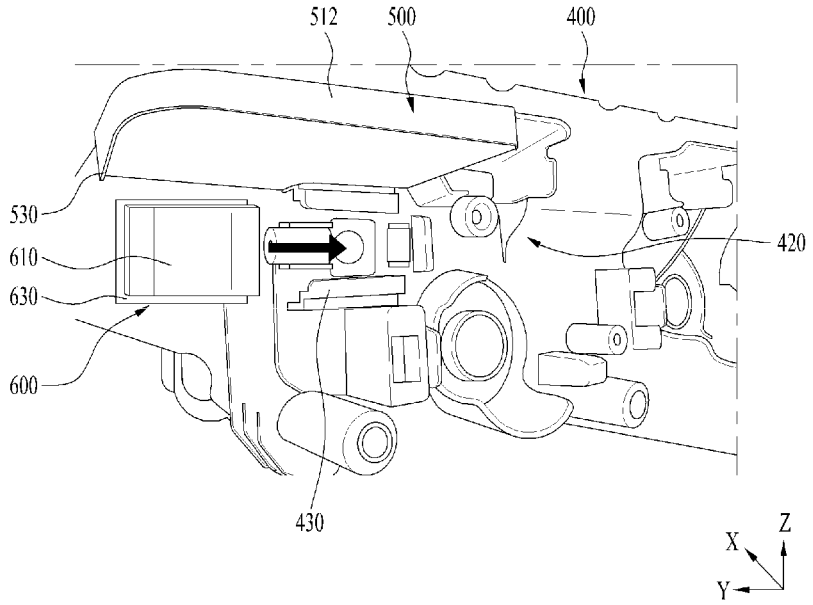
FIG. 9 is a view showing an introduction detector coupled to a supply case in the laundry treatment apparatus according to an embodiment of the present disclosure.

FIG. 9 is a view showing the introduction detector 600 coupled to the rear wall 420 of the supply case 400 according to an embodiment of the present disclosure. Referring to FIG. 9, the overhang panel 510 may be spaced apart from the introduction detector 600 in the vertical direction such that a space is formed between the overhang panel 510 and the introduction detector 600.

As described above, in the laundry treatment apparatus 1, unintended water leakage may occur or water may be condensed due to high humidity, thereby causing water to fall.

That is, water is likely to be condensed on the bottom surface of the overhang panel 510. The water condensed on the bottom surface of the overhang panel 510 may infiltrate into the introduction detector 600.

Accordingly, in an embodiment of the present disclosure, as the overhang panel 510 is formed to be inclined toward the front end 511 and one side end 513, and the overhang panel 510 and the introduction detector 600 are vertically spaced apart from each other, water condensed on the bottom surface of the overhang panel 510 may be prevented from contacting the introduction detector 600, and the condensed water may flow from the bottom surface of the overhang panel 510 to one side of the front so as to be discharged.

In an embodiment of the present disclosure, the overhang 500 may further include an overhang lower rib 530. The overhang lower rib 530 may protrude downward from the edge of the one side end 513 of the overhang panel 510.

FIG. 6 shows the overhang lower rib 530 of the overhang 500 viewed from the outside, and FIG. 8 shows a cross section of the overhang lower rib 530.

Even when water condensed on the bottom surface of the overhang panel 510 is concentrated at the one side end 513 and the front end 511 of the overhang panel 510, the water remain adhering to the bottom surface of the overhang panel 510 due to the viscosity of water.

In this case, harmful substances such as mold may be produced due to the remaining water, and thus, which may adversely affect the overall maintenance of the detergent supply device 100.

Accordingly, in the embodiment of the present disclosure, the overhang lower rib 530 protruding downward from an edge positioned at one side end 513 of the overhang panel 510 may be provided to cause the water condensed on the bottom surface of the overhang panel 510 to fall.

For example, when water present on the bottom surface of the overhang panel 510 reaches the overhang lower rib 530, it may move along the overhang lower rib 530, and the area of contact with water may be reduced due to the overhang lower rib 530. Accordingly, the water may be caused to fall.

As shown in FIG. 9, in an embodiment of the present disclosure, the supply case 400 may further include a slide coupling groove 430 formed in the rear wall 420. The introduction detector 600 may be slid and coupled to the slide coupling groove 430. The introduction detector 600 may be provided with a slide coupling portion 630 that is inserted into and coupled to the slide coupling groove 430 by sliding in the side direction of the supply case 400.

At least a part of the introduction detector 600 may be slid and coupled to the slide coupling groove 430. In the embodiment shown in FIG. 9, the slide coupling groove 430 is open to one side and extends from the one side to the opposite side.

The introduction detector 600 may include the slide coupling portion 630. The slide coupling portion 630 may be inserted and slid into the slide coupling groove 430. As the slide coupling portion 630 is coupled to the slide coupling groove 430, the introduction detector 600 may be fixed to the rear wall 420 of the supply case 400.

Figure 10:
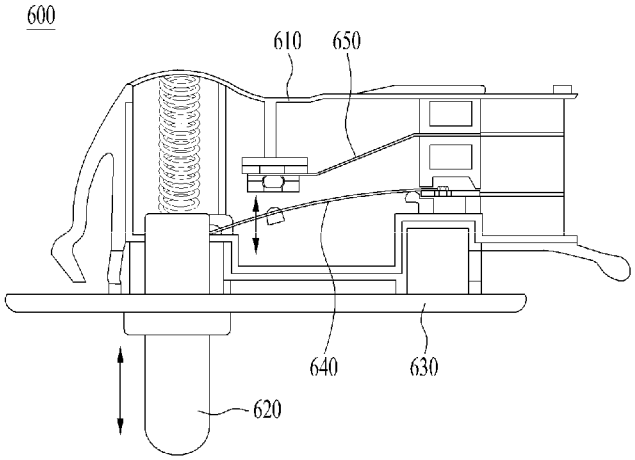
FIG. 10 is a view showing an interior of a first type of the introduction detector in the laundry treatment apparatus according to an embodiment of the present disclosure.
Figure 11:
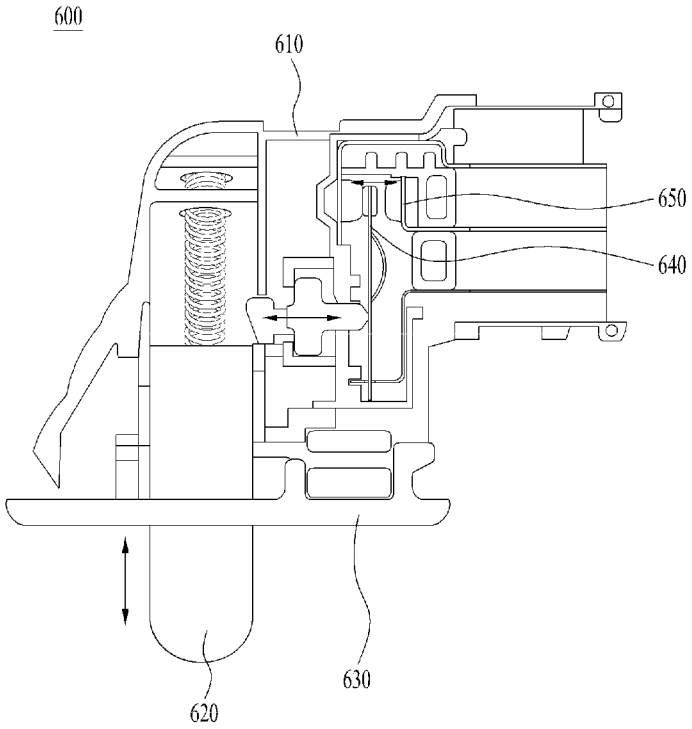
FIG. 11 is a view showing an interior of a second type of the introduction detector in the laundry treatment apparatus according to an embodiment of the present disclosure.

The slide coupling portion 630 may extend in the sliding direction. FIGS. 10 and 11 show the slide coupling portion 630 extended in the side direction of the supply case 400 according to an embodiment of the present disclosure.

The slide coupling portion 630 may be positioned at the front end of the introduction detector 600. Accordingly, when the slide coupling portion 630 is coupled to the slide coupling groove 430, the rear end of the introduction detector 600 may protrude rearward from the supply case 400.

A fixing means for preventing the slide coupling portion 630 coupled to the slide coupling groove 430 from being separated may be arranged on the rear wall 420 of the supply case 400. Once the slide coupling portion 630 is coupled to the supply case 400, the fixing means may be coupled to the supply case 400 to shield at least a part of the open portion of the slide coupling groove 430.

FIG. 5 schematically shows the introduction detector 600 coupled to the rear wall 420 of the supply case 400, and FIGS. 10 and 11 show the inside of the introduction detector 600 according to an embodiment of the present disclosure.

The introduction detector 600 may include a detection case 610 and a detection projection 620. The detection case 610 may be coupled to the rear wall 420 of the supply case 400 and may protrude rearward from the rear wall 420.

The slide coupling portion 630 described above may be integrated with the detection case 610 or may be coupled to the detection case 610. FIGS. 10 and 11 illustrate that the slide coupling portion 630 is provided at the front end of the detection case 610 and protrudes from the detection case 610 in the vertical direction according to an embodiment of the present disclosure.

The detection projection 620 may protrude forward from the detection case 610 and a front end thereof may be positioned inside the supply case 400 through the rear wall 420. The introduction detector 600 may be configured to detect whether the storage unit 300 is introduced based on whether the detection projection 620 is pressed by the storage unit 300.

Specifically, the detection projection 620 may extend forward from the detection case 610. The detection projection 620 may be arranged through the rear wall 420 of the supply case 400. That is, the detection projection 620 may be arranged such that the front end thereof is positioned inside the supply case 400.

The detection projection 620 may be a pressure sensor to sense pressure, or a displacement measuring means configured to be displaced from a position when pressed. In an embodiment of the present disclosure, when the storage unit 300 is accommodated in the supply case 400, the detection projection 620 may be pressed rearward by the rear end of the storage unit 300.

The introduction detector 600 may be configured to detect whether the storage unit 300 is completely introduced by detecting whether the detection projection 620 is pressed.

In an embodiment of the present disclosure, the detection projection 620 may be arranged to move in a front-back direction of the supply case 400 according to a pressure applied by the storage unit 300. The introduction detector 600 may include a first terminal 640 and a second terminal 650.

The first terminal 640 may be arranged inside the detection case 610, and at least a part of the first terminal 640 may be displaced from a position thereof according to movement of the detection projection 620. The second terminal 650 may be positioned on the movement path of the first terminal 640 inside the detection case 610.

The introduction detector 600 may be configured to detect whether the storage unit 300 is introduced based on a contact between the first terminal 640 and the second terminal 650.

FIG. 10 shows a first type of the introduction detector 600 according to an embodiment of the present disclosure, and FIG. 11 shows a second type of the introduction detector 600.

Referring to FIG. 10, the detection projection 620 may be arranged to be movable on the introduction detector 600 in the front-back direction. The detection projection 620 may be pressed rearward by the storage unit 300 whose front end is completely introduced. As the front end of the detection projection 620 is pressed, the detection projection 620 may be moved rearward.

The first terminal 640 may be arranged to be moved by the movement of the detection projection 620. That is, at least a part of the first terminal 640 may be displaced by the movement of the detection projection 620. At least a part of the first terminal 640 may be connected to the detection projection 620 to receive a displacement from the detection projection 620.

Referring to FIG. 10, one end of the first terminal 640 is fixed to the detection case 610 and the opposite end thereof is coupled to the detection projection 620 such that at least a part of the first terminal 640 is moved together with the detection projection 620 in the front-back direction.

At least a part of the second terminal 650 may be positioned on a movement path of the first terminal 640. That is, the second terminal 650 may contact the first terminal 640 as at least a part of the first terminal 640 is moved rearward.

The first terminal 640 and the second terminal 650 may be formed of a metal material that conducts electricity. Electrical current may be formed as the first terminal 640 and the second terminal 650 contact each other. The introduction detector 600 may generate the current caused by the contact between the first terminal 640 and the second terminal 650 as an introduction signal of the storage unit 300.

An elastic member to urge the detection projection 620 toward the supply case 400 may be arranged inside the detection case 610. That is, the detection projection 620 may be pressed and moved rearward by the storage unit 300. Then, when the storage unit 300 is withdrawn, the detection projection 620 may be moved forward by the elastic member to return to the original position thereof.

Referring to FIG. 11, a displacement transmission means may be arranged inside the introduction detector 600. When the detection projection 620 is moved rearward, the displacement transmission means may be pressed at least in part by the detection projection 620 and displaced in the side direction.

That is, the displacement transmission means may be a means to change the direction of displacement of the detection projection 620. In addition, the displacement transmission means may be a medium that transmits the displacement of the detection projection 620 to the first terminal 640.

The position of the first terminal 640 may be changed when at least a part of the first terminal 640 is coupled to the displacement transmission means or pressed by the displacement transmission means. Referring to FIG. 11, when the detection projection 620 is pressed by the storage unit 300, the detection projection 620 may be moved rearward, and the displacement transmission means may be moved from one side to the other side by the movement of the detection projection 620. Then, at least a part of the first terminal 640 may be moved from one side to the other side by the movement of the displacement transmission means. For example, the displacement transmission means can include a protrusion that extends in a lateral direction of the detection case 610.

The second terminal 650 may be spaced apart from the first terminal 640 to the one side. The second terminal 650 may be arranged such that at least a part thereof contacts the first terminal 640 when the first terminal 640 is moved to one side.

Accordingly, when the first terminal 640 comes into contact with the second terminal 650, a current may be formed in the introduction detector 600. The current may correspond to an electrical signal indicating the introduction of the storage unit 300.

The introduction detector 600 may include a controller or may be signally connected to the controller. The controller may determine whether the storage unit 300 is completely introduced based on the electrical signal generated by the introduction detector 600, and reflect the determination in the procedure of operation of the laundry treatment apparatus 1.

As is apparent from the above description, the present disclosure has effects as follows.

Embodiments of the present disclosure may provide a laundry treatment apparatus capable of effectively preventing water from infiltrating into electrical components.

Embodiments of the present disclosure may provide a laundry treatment apparatus capable of effectively improving the water resistance of electrical components by efficiently treating water present inside the laundry treatment apparatus.

It will be apparent to those skilled in the art that various modifications and variations can be made in the present disclosure without departing from the spirit and scope of the disclosure. Thus, it is intended that the present disclosure cover the modifications and variations of this disclosure provided they come within the scope of the appended claims and their equivalents.

What is claimed is:

1. A laundry treatment apparatus comprising:
a housing defining an opening at a front surface thereof;
a tub disposed in the housing;
a drum rotatably disposed in the tub;
a storage unit configured to store detergent, the storage unit being configured to be inserted into and withdrawn from the housing through the opening; and
a supply case disposed in the housing and configured to receive the storage unit inserted through the opening,
wherein the supply case comprises:
an introduction detector coupled to the supply case and configured to detect whether the storage unit is inserted into the housing, and
an overhang portion that protrudes from an outer surface of the supply case and covers an upper side of the introduction detector, the overhang portion being configured to block water falling toward the introduction detector.

2. A laundry treatment apparatus comprising:
a housing defining an opening at a front surface thereof;
a tub disposed in the housing;
a drum rotatably disposed in the tub; and
a storage unit configured to store detergent, the storage unit being configured to be inserted into and withdrawn from the housing through the opening; and
a supply case disposed in the housing and configured to receive the storage unit inserted through the opening,
wherein the supply case comprises:
an introduction detector coupled to the supply case and configured to detect whether the storage unit is inserted into the housing, and
an overhang portion positioned vertically above the introduction detector and configured to block water falling toward the introduction detector,
wherein the overhang portion comprises:
an overhang panel positioned vertically above the introduction detector, and
an overhang upper rib that protrudes upward from the overhang panel and extends along at least a part of an edge of the overhang panel, the overhang upper rib being configured to block water falling out of the overhang panel.

3. The laundry treatment apparatus of claim 2, wherein the edge of the overhang panel has:
a first part that includes the overhang upper rib; and
a second part that is outside the overhang upper rib and defines a discharge region configured to discharge water from the overhang panel.

4. The laundry treatment apparatus of claim 3, wherein the introduction detector and the overhang panel protrude rearward relative to a rear wall of the supply case,
wherein the overhang panel has a first side end that is coupled to the rear wall and extends in a lateral direction of the supply case, and
wherein the discharge region is defined at the first side end of the supply case.

5. The laundry treatment apparatus of claim 4, wherein the introduction detector is arranged at the rear wall and positioned below the first side end of the supply case, and
wherein the overhang panel has a second side end that extends rearward relative to the introduction detector.

6. The laundry treatment apparatus of claim 4, wherein the first side end of the overhang panel is positioned vertically above the tub.

7. The laundry treatment apparatus of claim 4, wherein the overhang panel is inclined with respect to a horizontal direction and configured to guide water on the overhang panel to the discharge region.

8. The laundry treatment apparatus of claim 7, wherein a front end of the overhang panel is positioned lower than a rear end of the overhang panel, and
wherein the discharge region includes a part of the front end at the first side end of the overhang panel.

9. The laundry treatment apparatus of claim 7, wherein the overhang panel has a second side end that extends rearward relative to the introduction detector, and
wherein the first side end of the overhang panel is positioned lower than the second side end of the overhang panel.

10. The laundry treatment apparatus of claim 9, wherein the overhang panel is vertically spaced apart from the introduction detector and defines a space between the overhang panel and the introduction detector.

11. The laundry treatment apparatus of claim 10, wherein the overhang portion further comprises:

an overhang lower rib that protrudes downward from the edge at the first side end of the overhang panel toward the introduction detector.

12. The laundry treatment apparatus of claim 1, wherein the supply case further comprises a rear wall that defines a slide coupling groove, the slide coupling groove being configured to be coupled to the introduction detector based on the introduction detector being inserted to the supply case in a lateral direction of the supply case, and wherein the introduction detector comprises a slide coupling portion that is configured to insert into and couple to the slide coupling groove in the lateral direction.

13. The laundry treatment apparatus of claim 1, wherein the introduction detector comprises:

a detection case that is coupled to a rear wall of the supply case and protrudes rearward relative to the rear wall; and a detection projection that protrudes forward relative to the detection case, the detection projection passing through the rear wall and having a front end positioned inside the supply case, and wherein the introduction detector is configured to, based on the detection projection being pressed by the storage unit, detect that the storage unit is inserted into the housing.

14. A laundry treatment apparatus comprising:

a housing defining an opening at a front surface thereof;

a tub disposed in the housing;

a drum rotatably disposed in the tub; and a storage unit configured to store detergent, the storage unit being configured to be inserted into and withdrawn from the housing through the opening; and a supply case disposed in the housing and configured to receive the storage unit inserted through the opening, wherein the supply case comprises:

an introduction detector coupled to the supply case and configured to detect whether the storage unit is inserted into the housing, and an overhang portion positioned vertically above the introduction detector and configured to block water falling toward the introduction detector, wherein the introduction detector comprises:

a detection case that is coupled to a rear wall of the supply case and protrudes rearward relative to the rear wall, a detection projection that protrudes forward relative to the detection case, the detection projection passing through the rear wall and having a front end positioned inside the supply case, a first terminal arranged in the detection case, at least a part of the first terminal being configured to move based on movement of the detection projection, and a second terminal positioned in a movement path of the first terminal in the detection case, wherein the detection projection is configured to move based on being pressed by the storage unit, wherein the introduction detector is configured to, based on the detection projection being pressed by the storage unit, detect that the storage unit is inserted into the housing, and wherein the introduction detector is configured to, based on the first terminal contacting the second terminal, detect that the storage unit is inserted into the housing.

15. The laundry treatment apparatus of claim 14, wherein each of the first terminal and the second terminal comprises a metal plate.

16. The laundry treatment apparatus of claim 14, wherein the detection projection extends in a front-rear direction through the rear wall of the supply case, wherein the first terminal and the second terminal are spaced apart from each other in the front-rear direction and extend in a lateral direction of the detection case, and wherein the first terminal has a first end that is connected to the detection projection and that is configured to, based on the detection projection moving in the front-rear direction, move in the front-rear direction and contact a front side of the second terminal.

17. The laundry treatment apparatus of claim 16, wherein a second end of the first terminal is fixed to the detection case, and the front end of the second terminal is fixed to the detection case.

18. The laundry treatment apparatus of claim 14, wherein the detection projection extends in a front-rear direction through the rear wall of the supply case, wherein the first terminal and the second terminal extend in the front-rear direction and are spaced apart from each other in a lateral direction of the detection case, and wherein the introduction detector further comprises a transmission protrusion that is disposed between the detection projection and the first terminal, the transmission protrusion being configured to, based on the detection projection moving in the front-rear direction, move in the lateral direction and push the first terminal to the second terminal.

19. The laundry treatment apparatus of claim 18, wherein the transmission protrusion has:

a first surface configured to contact the detection projection based on the detection projection moving in the a rear direction; and a second surface spaced apart from the first surface in the lateral direction and configured to move in the lateral direction and contact the first terminal.

20. The laundry treatment apparatus of claim 3, wherein the discharge region is configured to discharge water from the overhang panel to the tub.

* * * * *